US006789359B2

(12) United States Patent
Bauman et al.

(10) Patent No.: US 6,789,359 B2
(45) Date of Patent: Sep. 14, 2004

(54) WEEPED END PLUG FOR SILL ASSEMBLY

(75) Inventors: William H. Bauman, Merrill, WI (US); Mark R. Meyer, Merrill, WI (US)

(73) Assignee: Merrill Millwork, Inc., Merrill, WI (US)

( * ) Notice: Subject to any disclaimer, the term of this patent is extended or adjusted under 35 U.S.C. 154(b) by 111 days.

(21) Appl. No.: 10/016,500

(22) Filed: Dec. 10, 2001

(65) Prior Publication Data

US 2003/0106269 A1 Jun. 12, 2003

(51) Int. Cl.[7] ..... E06B 1/70
(52) U.S. Cl. ..... 49/471; 52/209
(58) Field of Search ..... 49/467, 471; 52/209, 52/204.52

(56) References Cited

U.S. PATENT DOCUMENTS

| | | | | | |
|---|---|---|---|---|---|
| 3,273,287 | A | | 9/1966 | Pease, Jr. | |
| 3,410,027 | A | * | 11/1968 | Bates | 49/471 |
| 3,501,866 | A | | 3/1970 | Johnson | |
| 3,762,100 | A | | 10/1973 | Kempel | |
| 3,851,420 | A | | 12/1974 | Tibbetts | |
| 3,900,967 | A | | 8/1975 | Bursk et al. | |
| 3,967,412 | A | | 7/1976 | Governale | |
| 4,074,464 | A | | 2/1978 | McCay | |
| 4,125,141 | A | * | 11/1978 | Stillwell | 160/91 |
| 4,224,766 | A | | 9/1980 | Procton | |
| 4,282,691 | A | | 8/1981 | Risdon | |
| 4,352,258 | A | | 10/1982 | Bursk et al. | |
| 4,387,535 | A | | 6/1983 | Corbo | |
| 4,447,987 | A | | 5/1984 | Kesosky | |
| 4,492,062 | A | * | 1/1985 | Levenez | 52/97 |
| 4,691,487 | A | * | 9/1987 | Kessler | 52/209 |
| 4,831,779 | A | | 5/1989 | Kehrli et al. | |
| 4,891,921 | A | | 1/1990 | Governale | |
| 5,012,614 | A | | 5/1991 | Shea | |
| 5,067,279 | A | * | 11/1991 | Hagemeyer | 49/471 |
| 5,136,814 | A | | 8/1992 | Headrick | |
| 5,179,804 | A | | 1/1993 | Young | |
| 5,426,894 | A | | 6/1995 | Headrick | |
| 5,611,173 | A | | 3/1997 | Headrick et al. | |
| 5,687,508 | A | | 11/1997 | Fitzhenry, Jr. et al. | |
| 5,836,120 | A | | 11/1998 | DeBower | |
| 5,887,387 | A | | 3/1999 | Dallaire | |
| 6,098,355 | A | * | 8/2000 | Li | 52/212 |
| 6,105,323 | A | | 8/2000 | Paulle | |
| 6,138,413 | A | | 10/2000 | Fehr | |
| 6,170,207 | B1 | | 1/2001 | Saindon | |
| 6,357,186 | B1 | * | 3/2002 | Gould | 52/209 |
| 6,374,557 | B1 | * | 4/2002 | O'Donnell | 52/209 |
| 6,637,158 | B2 | * | 10/2003 | Bennett | 49/504 |
| 2003/0005644 | A1 | * | 1/2003 | Reithmeyer et al. | 49/467 |

* cited by examiner

*Primary Examiner*—Gregory J. Strimbu
(74) *Attorney, Agent, or Firm*—Andrus, Sceales, Starke & Sawall, LLP

(57) ABSTRACT

A sill assembly for doors and windows that provides a weep system for channeling water away from the sill assembly. The sill assembly includes an elongated frame member formed with a longitudinally extending upwardly open channel that defines a rear wall, a front wall and a floor that extends laterally and slopes downwardly from the rear wall to the front wall, and a sill that extends laterally from the front wall to a forward edge of the frame member. An end plug is securely mounted to one end of the elongated frame member and has a laterally extending drainage ramp disposed at a location flush with and immediately adjacent to the floor of the channel. The ramp leads to a drainage chamber which in turn has an opening closed by a hinged weep door. Water collected in the channel of the frame member or that may get past the primary weather-strip of a door or window is collected in the channel and is fed to the ramp which in turn directs the water into the drainage chamber and out the weep door so that the water is directed away from the sill assembly.

11 Claims, 5 Drawing Sheets

FIG. 1
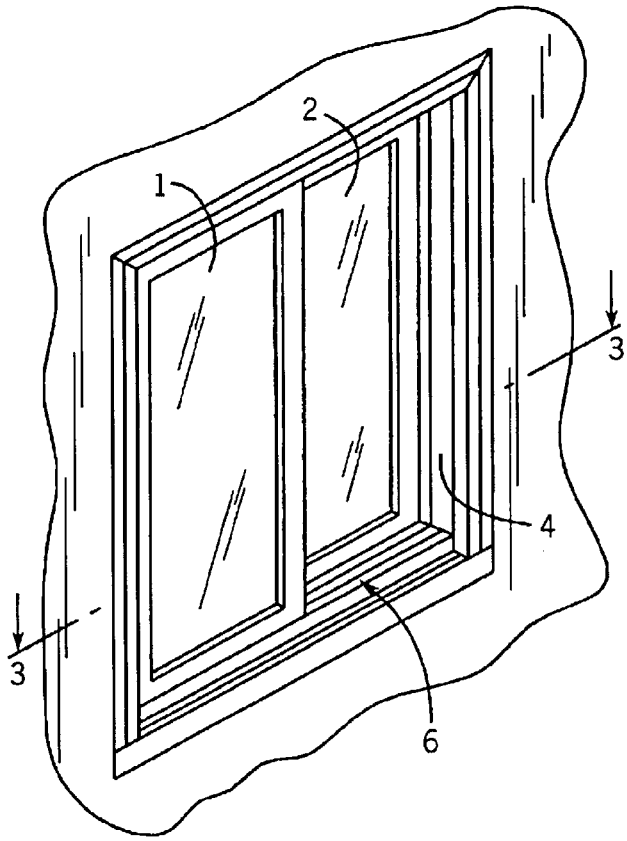
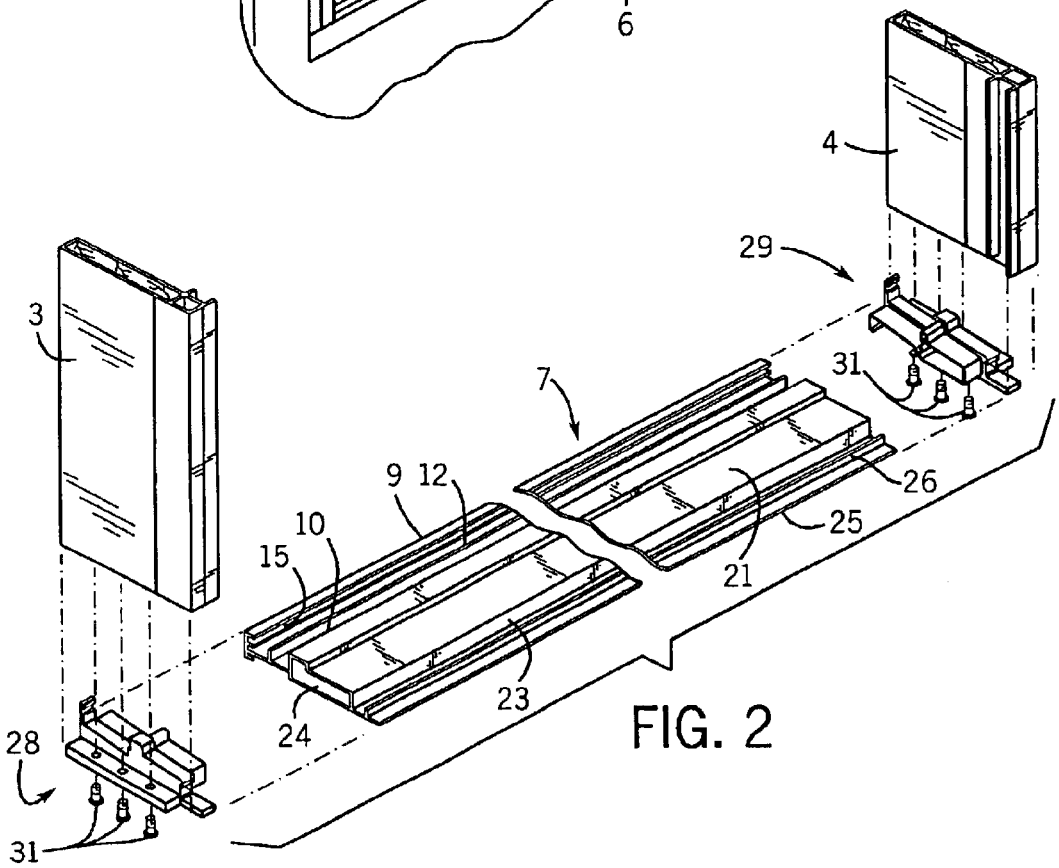
FIG. 2

WEEPED END PLUG FOR SILL ASSEMBLY

BACKGROUND OF THE INVENTION

The present invention is directed to sill assemblies for doors or windows, and more particularly to an end plug having an integral weep system for channeling water away from the sill assembly.

Sill assemblies are typically associated with doors and windows, and provide a transition from the exterior or outside environment and the interior space of a dwelling. Such sill assemblies are anchored to the lower, horizontal jamb of a door frame or window frame and provide a sealing and weather-proofing barrier for the doorway or window opening of the dwelling.

Sill assemblies may be manufactured of various materials, but most recent constructions utilize fiberglass or other thermoplastic material manufactured by conventional extrusion techniques. Fiberglass sill assemblies provide excellent weatherability, are attractive in appearance, are lightweight for ease of shipping and handling, are relatively wear resistant, and are virtually maintenance-free. However, it is often necessary to custom cut and fit each sill assembly to the particular doorway or window opening. Cutting and fitting materials such as fiberglass, although not difficult, is messy and undesirable due to the release of dust and fibers during the cutting process.

Sill assemblies must also provide adequate run-off for rain and/or melted snow so that there is no accumulation of water in or around the doorway or window frame that may cause mildew, rot or other water damage. For example, water from rain or snow may tend to seep through the interface between the door or window and sill to accumulate in the channels formed in the sill assembly. Other leaks can develop at the ends of the sill assembly where it is secured to the bottoms of the vertical door frame jambs or window frame jambs.

In order to eliminate the accumulation of water in sill assemblies, various types of weep systems have been incorporated in attempts to channel water away from the sill assembly. Examples of such systems are shown in U.S. Pat. Nos. 5,136,814, 5,012,614 and 3,900,967. In addition, the incorporation of weep doors along the outer edges of sill assemblies is also known. However, typically such installations require the machining or cutting of slots and/or holes in the fiberglass sill to provide a weeping path for the water. As noted above, the machining or cutting of fiberglass is undesirable and preferably should be eliminated if at all possible. In addition, the weeped doors used to date are relatively small and can easily become blocked by the accumulation of dirt, leaves, and the like.

SUMMARY OF THE INVENTION

The present invention is directed toward a sill assembly for doors and windows that provides a unique and improved weep system for channeling water away from the sill assembly. The present assembly provides a new and better arrangement which is simple in construction, minimizes production costs, and includes improvements that will enable greater ease of installation and which effectively provide adequate run-off for water that may accumulate from rain or melted snow.

In order to accomplish this, the sill assembly of the present invention provides an elongated frame member formed with a longitudinally extending, upwardly open channel that defines a rear wall, a front wall and a floor that extends laterally and slopes downwardly from said rear wall to said front wall, and a sill that extends laterally from the front wall to a forward edge of the frame member. An end plug is mounted to one end of the elongated frame member and has a laterally extending drainage ramp disposed flush with and immediately adjacent the floor of the channel of the elongated frame member. The ramp has a forward edge which leads to a drainage chamber disposed beneath the sill of the frame member. The chamber is at least partially defined by an outer wall near the forward edge of the frame member which has an opening therein which in turn is closed by a hinged weep door. As a result, water that may accumulate in the channel, or water that may run down the exterior surface of a door or window onto the frame member flows to one end of the channel and onto the ramp which in turn directs the water into the drainage chamber and then through the weep door and away from the sill assembly.

The invention is also directed toward the end plug itself used in the sill assembly. The end plug includes an elongate body having a rearward portion and a forward portion, and is defined by a rear wall, a front wall and an upstanding support wall extending longitudinally between the front and rear walls. A ramp integrally formed on the top of the support wall in the rearward portion of the body extends forwardly and slopes downwardly from the rear wall to a front edge thereof. A drainage chamber is formed in the forward portion of the body of the end plug and communicates with the front edge of the ramp and is defined at least partially by the support wall and the front wall of the elongate body. The front wall of the end plug has an opening formed therein which is preferably closed by a hinged weep door. Thus, the ramp directs water received thereon into the chamber where it drains through the opening in the front wall away from the door or window assembly. The end plug also includes a guide member in the form of a substantially channel-shaped flange which extends laterally from the support wall is and is used to properly position the end plug in one end of a frame member of the sill assembly so that the ramp is positioned at a location flush with and immediately adjacent to the floor of a channel for the frame member. The end plug also includes an integral mounting plate extending laterally from the support wall for mounting an upstanding jamb of a sill assembly thereto.

The novel end plug and sill assembly disclosed herein provides a unique and improved weep system for channeling water away from the sill assembly. The only fabrication necessary is to cut the sill assembly to the proper length which avoids the machining of various slots and/or other openings in the sill assembly. The end plug provides three different functions in one embodiment, namely, a weep system, a plug for the end of the sill in order to contain the water to the sill rather than the surrounding frame work, and the fastening of a jamb to the sill. By incorporating all of these features into a single end plug, the sill assembly minimizes production costs and provides ease of installation.

BRIEF DESCRIPTION OF THE DRAWINGS

The drawings illustrate the best mode presently contemplated of carrying out the invention.

In the drawings:

FIG. 1 is a partial, perspective elevational view showing a door assembly installed in the side of a dwelling wherein the sill assembly and novel end plug of the present invention are installed;

FIG. 2 is a partial, perspective, exploded view showing the components of the sill assembly of the present invention;

DETAILED DESCRIPTION OF THE INVENTION

Figure 3:
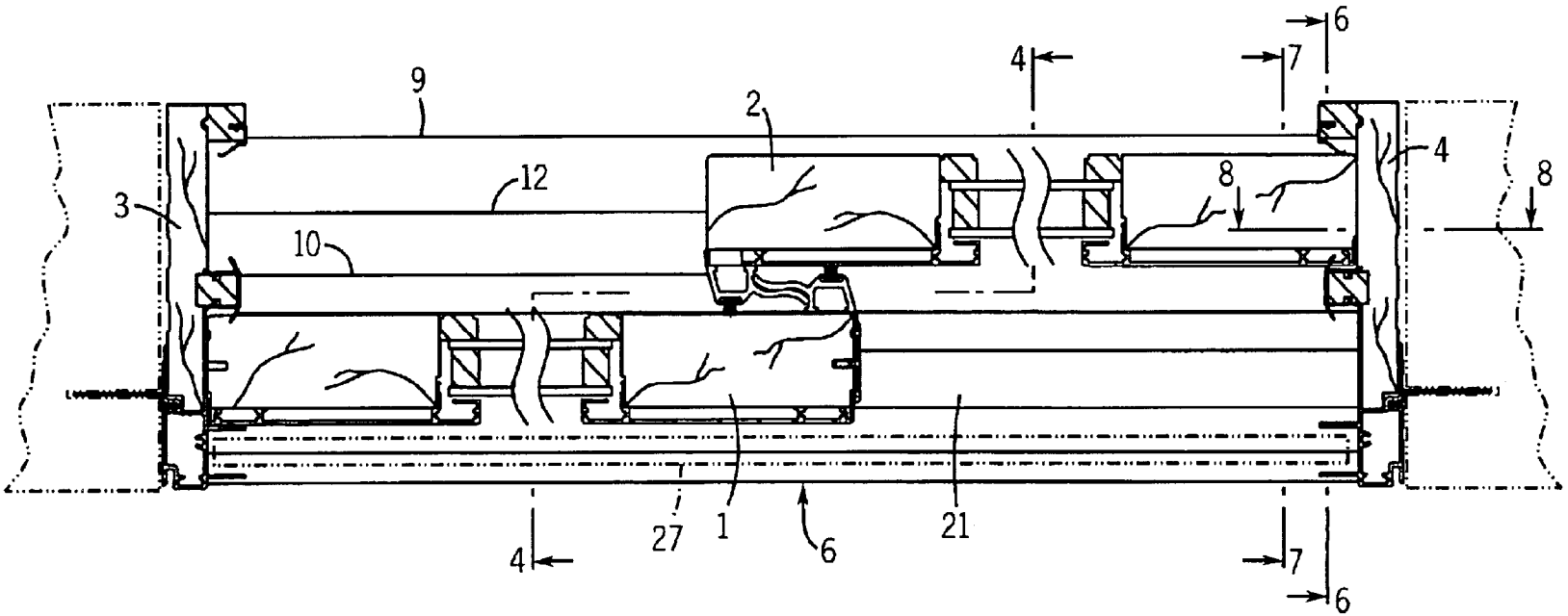
FIG. 3 is a sectional view taken along the line 3—3 in FIG. 1 illustrating the door assembly.

Referring now to the drawings, FIG. 1 illustrates a doorway between the exterior and interior of a dwelling. The doorway includes a stationary door 1, and a sliding door 2 mounted within a door frame assembly which includes two vertically extending jambs, namely, a left jamb 3 and a right jamb 4, and a horizontally extending jamb, namely, a head 5. The doorway also includes a sill assembly 6 which provides a sealing and weather-proofing barrier for the bottom of the doorway. It should be noted that although the sill assembly 6 is illustrated as being utilized in connection with a door assembly, this system could also be utilized with a window assembly, and thus the description herein should not be limited to door assemblies only.

Figure 4:
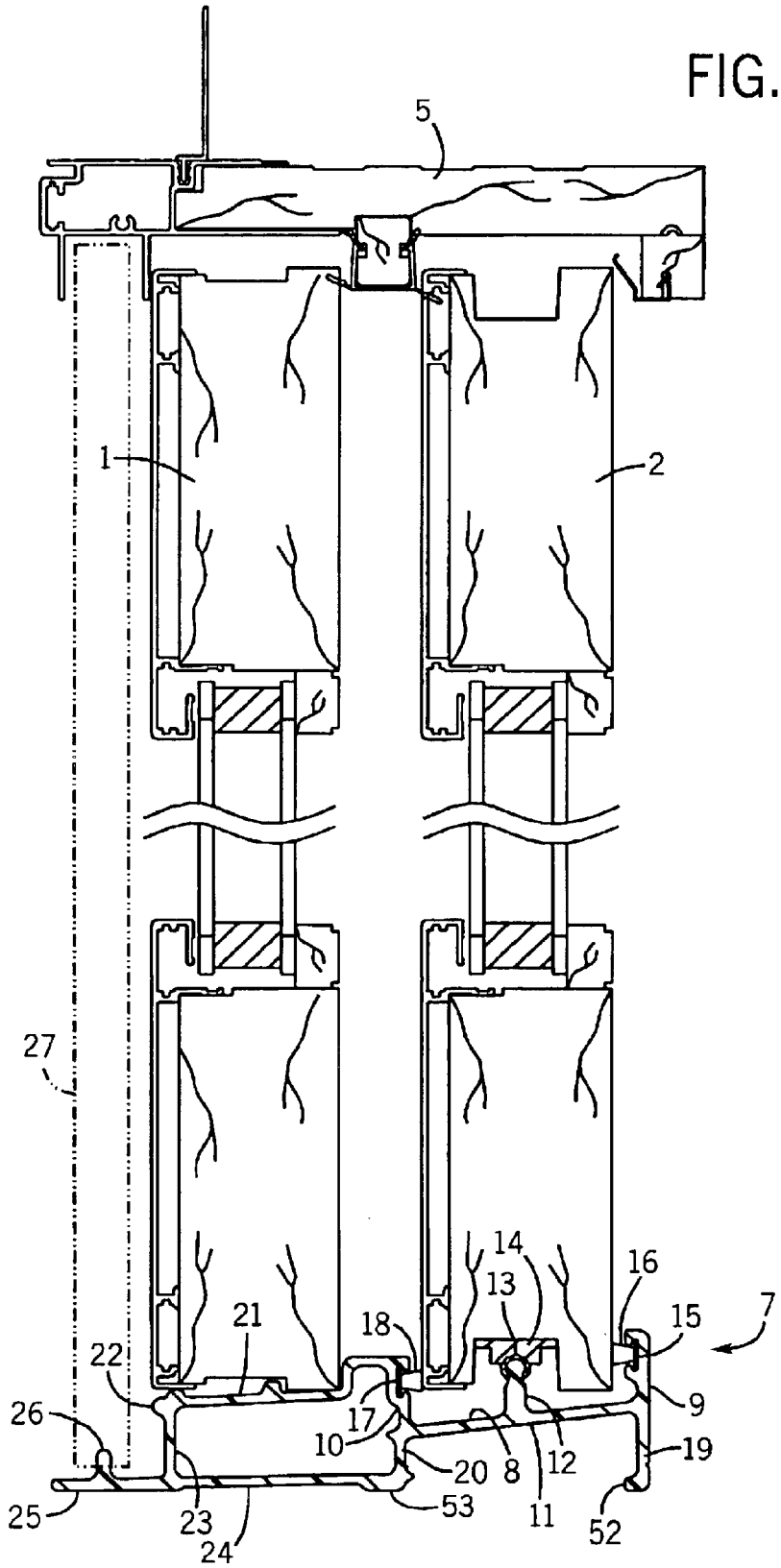
FIG. 4 is a cross-sectional view taken along the line 4—4 in FIG. 3 illustrating an elevational view of the door assembly.

Referring now to FIG. 2, the sill assembly 6 includes an elongated frame member 7 which is preferably formed of a unitary length of extruded or molded fiberglass or other thermoplastic material that has sufficient strength, resistant to wear and that is not subject to expansion and contraction due to moisture absorption. As best shown in FIG. 4, the frame member 7 is formed with a longitudinally extending upwardly open channel 8 that is defined by rear wall 9, a front wall 10 and a bottom floor 11 extending laterally from wall 9 to wall 10. As seen best in FIG. 4, bottom floor 11 tapers forwardly and downwardly from rear wall 9 to front wall 10 so that water in channel 8 tends to flow away from rear wall 9 and toward front wall 10. A longitudinally extending roller track 12 is also formed substantially in the center of channel 8. Roller track 12 has a rounded top edge which is covered by a generally C-shaped strip 13 of stainless steel metal. Strip 13 captures the top edge of the roller track 12 between its opposed legs to be secured thereon. As illustrated best in FIG. 4, sliding door 2 rides on roller track 12 during its sliding movement between its opened and closed positions via a bearing assembly 14. As also shown best in FIG. 4, rear wall 9 includes a longitudinally extending T-shaped slot 15 which receives a strip 16 of weather-proofing material that bears against the bottom rear surface of sliding door 2. Likewise, front wall 10 includes a longitudinally extending T-shaped slot 17 which in turn receives a strip of weather-proofing material that bears against the bottom outer surface of sliding door 2. Strips 16 and 18 provide weather-proofing along the bottom of door 2, and also aid in preventing the accumulation of dust, dirt, leaves and the like in channel 8.

As also illustrated best in FIG. 4, frame member 7 includes a rear support leg 19 and a front support leg 20 spaced therefrom. Legs 19 and 20 extend longitudinally and vertically beneath channel 8 to provide support for channel 8.

Figure 7:
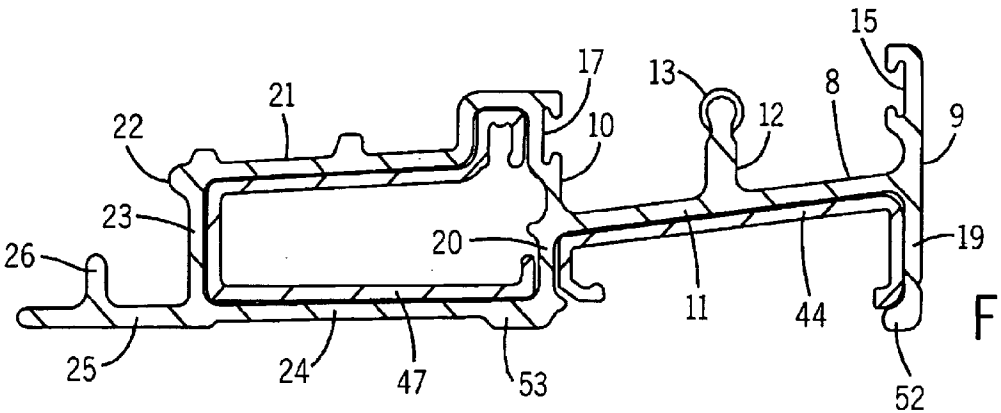
FIG. 7 is a cross-sectional view taken along the line 7—7 in FIG. 3.

Front leg 20 also provides support for a sill portion 21 of frame member 7. Sill portion 21 extends laterally from front wall 10 of channel 8 and slopes downwardly and forwardly therefrom to a forward edge 22 which is defined by the top of a forward wall 23. A longitudinally extending base plate 24 completes sill portion 21 so that as seen best in FIG. 7, the forward portion of sill assembly 6 which includes sill portion 21 is essentially a hollow, substantially rectangular-shaped structure which extends longitudinally the entire length of frame member 7. Base plate 24 also includes a forwardly projecting flat flange 25 which extends beyond forward edge 22. The flange 25 includes a screen track 26 extending the length thereof which is used to support a sliding screen door 27, as shown best in FIGS. 3 and 4. Legs 19 and 20 are preferably formed with laterally extending feet portions 52 and 53 that, together with base plate 24 and flange 25, rest firmly upon the wood framing of the doorway.

FIG. 2 also illustrates that the sill assembly 6 further includes a pair of end plugs 28 and 29 which are adapted to be securely mounted to opposite ends of elongated frame member 7. End plugs 28 and 29 function to contain the water to the sill assembly 6 so that it does not reach the surrounding wood framework of the door assembly, provides a weep system for draining water away from the sill assembly, and provides a mechanism for fastening the jambs 3 and 4 to sill assembly 6. As both end plugs 28 and 29 are mirror images of one another, only one need be described herein.

Figure 5A:
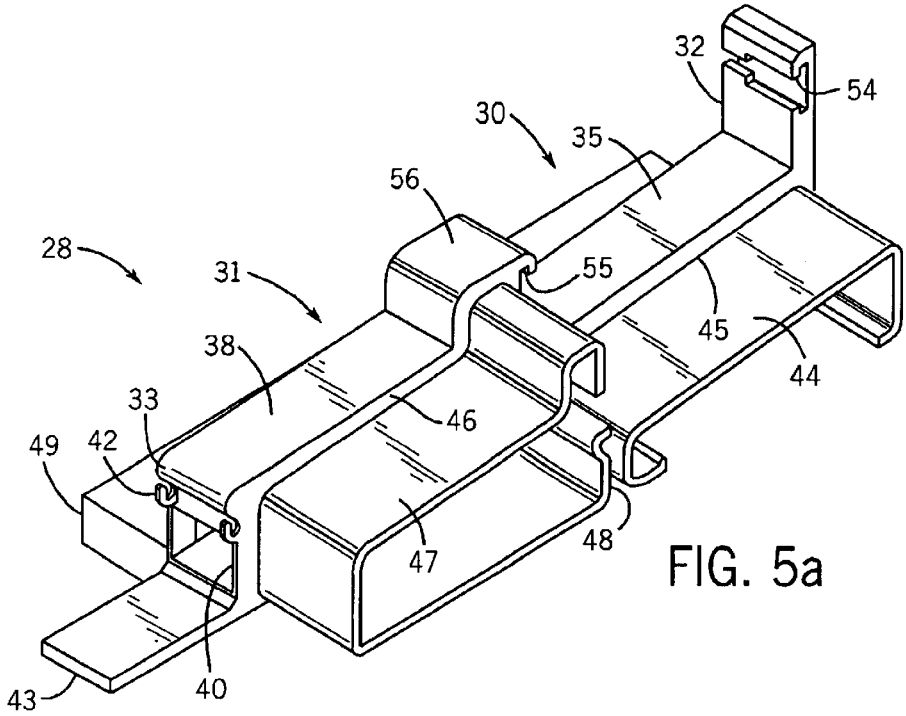
FIG. 5*a* is a perspective view of a weeped end plug for use in the sill assembly of the present invention.
Figure 5B:
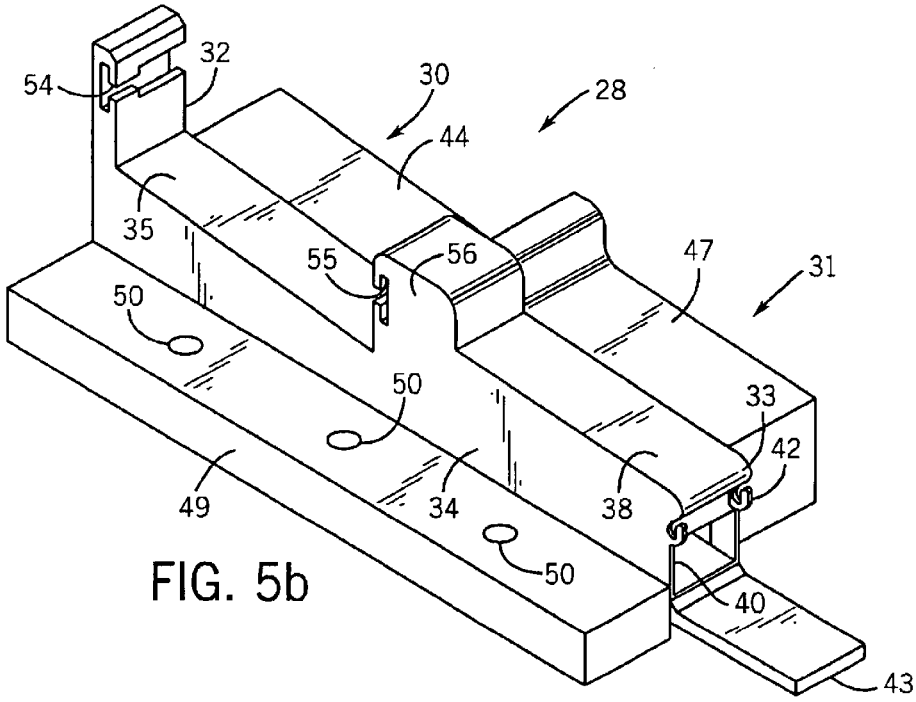
FIG. 5*b* is an opposite perspective view of the weeped end plug of FIG. 5*a;*
Figure 6:
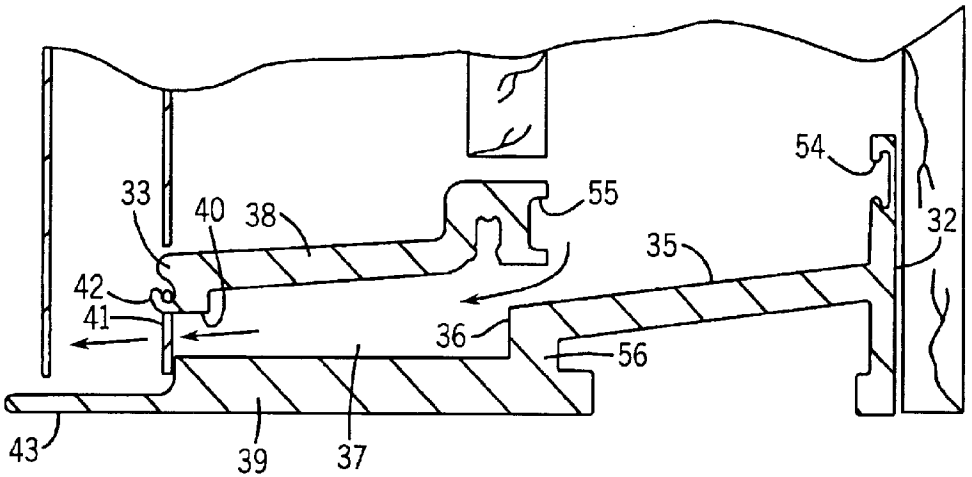
FIG. 6 is a cross-sectional view taken along the line 6—6 in FIG. 3.

Accordingly, referring to FIGS. 5*a* and 5*b*, end plug 28 is illustrated and is preferably formed as an integral one-piece unit by injection molding of an appropriate plastic material such as glass filled nylon. As illustrated, end plug 28 is formed as an elongate body having a rearward portion 30 and a forward portion 31. In particular, end plug 28 is defined by a rear wall 32, a center wall 56, a front wall 33, and an upstanding main support wall 34 extending longitudinally between rear wall 32, center wall 56 and front wall 33. As illustrated, rear wall 32 and front wall 33 project laterally to the right from the rear edge and front edge, respectively, of support wall 34. Rear wall 32 and center wall 56 each have a T-shaped groove 54 and 55, respectively, formed therein at a location which coincides with T-shaped slots 15 and 17 for receipt of strips 16 and 18 of weather-proofing material therein, when plug 28 is mounted on the end of frame member 7. A ramp 35 is integrally formed along the top edge of support wall 34 in the rearward portion 30 thereof. Ramp 35 has a planar upper surface and projects laterally, or to the right, from wall, 34 to have a width that is coextensive with the width of rear wall 32. As shown best in FIG. 6, ramp 35 extends forwardly and slopes downwardly from rear wall 32 and terminates at a front edge 36. The slope of ramp 35 is identical to the slope of bottom floor 11 of channel 8 so that the upper surface of ramp 35 is disposed at a location flush with and immediately adjacent to floor. 11 of channel 8 when it is assembled onto the end of frame member 7.

A drainage chamber 37 is formed in the forward portion 31 of end plug 28. Drainage chamber 37 communicates with the front edge 36 of ramp 35, as shown best in FIG. 6, and is defined by front wall 33, support wall 34 and a top wall 38 which extends laterally from the top edge of wall 34 to have a width that is coextensive with the width of front wall 40, ramp 35 and rear wall 32. As shown best in FIG. 6, a planar-shaped base 39 forms the lower wall for drainage chamber 37, and further supports end plug 28 along its underside. As illustrated, the forward end of base 39 supports front wall 33 while the rearward end thereof supports front edge 36 of ramp 35.

Front wall 33 includes an opening 40 formed therethrough which enables water to drain from chamber 37. Opening 40 is rectangular in shape and is closed by a weep door 41 (shown in FIG. 6 but not in FIGS. 5*a* and 5*b*) that includes a hinge mechanism 42 along its top edge to enable door 41 to swing open or to close by the force of gravity. Base 39 also includes a tongue 43 extending forwardly of front wall 33. Tongue 43 has a width substantially coextensive with ramp 35 and top wall 38, and a length substantially the same as the length of flange 25 extending from frame member 7.

End plug 28 also includes a guide member 44 extending laterally to the right from support wall 34 beyond ramp 35. As shown best in FIG. 5*a*, guide member 44 is in the shape of a substantially channel-shaped or C-shaped flange. As shown best in FIG. 7, guide member 44 has a profile which substantially matches the inner surfaces of support legs 19 and 20 and the bottom surface of channel 8 so that when end plug 28 is mounted on one end of frame member 7, guide member 44 properly positions end plug 28 thereon so that ramp 35 is flush with and immediately adjacent floor 11 of channel 8 and the edge of frame member 7 abuts against shoulder 45 in rearward portion 30 of end plug 28 and shoulder 46 in forward portion 31 of end plug 28.

It should be noted that drainage chamber 37 also is defined by a laterally projecting substantially rectangular-shaped guide member 47 extending laterally to the right from top wall 38 and front wall 33 which also functions to properly position end plug 28 within the hollow sill portion 21 of frame member 7. It should be noted that the profile of guide member 47 substantially corresponds with the profile of the hollow sill portion so that guide member 47 is readily received therein, as shown best in FIG. 7. Guide members 44 and 47 thus function to properly position end plug 28 with respect to frame member 7. In addition, when assembling end plug 28 to frame member 7, epoxy is typically coated on the external surfaces of guide members 44 and 47 so that when received within one end of frame member 7, as shown best in FIG. 7, end plug 28 is securely mounted to frame member 7. Silicone can then be used to seal any interface between end plug 28 and frame member 7, and is typically applied along the junction of the edge of frame member 7 and shoulders 45 and 46. In addition, FIG. 5*a* illustrates that a slot 48 is formed between guide member 44 and guide member 47. Slot 48 is present in order to accommodate front support leg 20, as illustrated best in FIG. 7.

End plug 28 also includes a mounting plate 49 extending laterally to the left from the bottom edge of support wall 34, as shown best in FIG. 5*b*. Mounting plate 49 also extends longitudinally between rear wall 32 and front wall 33, and functions to mount the upstanding jamb 3 of the door assembly, as shown best in FIG. 2. Mounting plate 49 includes a plurality of openings 50 formed therethrough for accommodating screws 51 which extend upwardly through plate 49 into the bottom edge of jamb 3. As illustrated in FIG. 2, the opposite jamb 4 is mounted in the identical manner except utilizing end plug 29 in the opposite end of frame member 7.

The configuration of sill assembly 6, as described herein, insures that water collected in channel 8 flows freely to the end of channel 8 and onto ramp 35. Ramp 35 then directs the water into drainage chamber 37 which in turn allows the water to drain through opening 40 and weep door 41. Further, any water that may get past the primary weather-strip 18 is collected in channel 8 and is also fed to ramp 35, chamber 37 and out door 41 so that the water is directed away from sill assembly 6. As a consequence, seepage of water beneath sill assembly 6 and onto wood framing members of the doorway structure is virtually eliminated. The rot and deterioration often associated with prior art sill assemblies is thus eliminated.

We claim:

1. A sill assembly comprising:

an elongated frame member formed with a longitudinally extending upwardly open channel that defines a rear wall, a front wall and a floor that extends laterally and slopes downwardly from said rear wall to said front wall, and a sill that extends laterally and slopes downwardly from said front wall to a forward edge of said frame member; and an end plug adapted to be securely mounted to one end of said elongated frame member, said end plug comprising an elongate body having a rearward portion and a forward portion, said body having a rear wall and a front wall and an upstanding support wall extending longitudinally between said rear and front walls of said body;

a drainage ramp integrally formed on said support wall in the rearward portion of said body, said ramp extending forwardly and sloping downwardly from said rear wall of said body to a front edge of said ramp, and said ramp extending laterally from said support wall and having an outer end forming a shoulder engagable with said one end of said elongated frame member;

a drainage chamber formed in the forward portion of said body, said drainage chamber communicating with the front edge of said ramp and defined at least partially by said support wall, said front wall of said body and by a top wall extending laterally from said support wall and sloping downwardly between said front edge of said ramp and said front wall of said body, said chamber having an outer end forming a shoulder engagable with said one end of said elongated frame member, the shoulder of said top wall aligned with the shoulder of said ramp so that said ramp is disposed at a location flush with and immediately adjacent to the floor of said channel; and said front wall of said body having an opening formed therein, whereby water in said channel flows to said one end of said frame member and onto said ramp which directs said water into said chamber and through the opening in said front wall of said body away from said frame member.

2. The sill assembly of claim 1 wherein said end plug further includes a hinged weep door closing said opening in said front wall.

3. The sill assembly of claim 1 wherein said end plug further includes a mounting plate extending laterally and longitudinally adjacent said ramp for mounting an upstanding jamb thereto.

4. The sill assembly of claim 1 wherein said frame member further includes a pair of spaced support members extending longitudinally and vertically beneath said channel, and said end plug further includes a guide member adapted to be inserted between said support members to properly position said end plug on said one end of said frame member.

5. The sill assembly of claim 4 wherein said guide member comprises a flange.

6. An end plug for use in a sill assembly, comprising:

an elongate body having a rearward portion and a forward portion, said body having a rear wall and a front wall and an upstanding support wall extending longitudinally between said rear and front walls;

a ramp integrally formed on said support wall in the rearward portion of said body, said ramp extending forwardly and sloping downwardly from said rear wall to a front edge of said ramp;

and said ramp extending laterally from said support wall and having an outer end forming a shoulder;

a drainage chamber formed in the forward portion of said body, said drainage chamber communicating with the front edge of said ramp and defined at least partially by said support wall, said front wall and by a top wall extending laterally from said support wall and sloping downwardly between said front edge and said front wall, said chamber having an outer end forming a shoulder, the shoulder of said top wall aligned with the shoulder of said ramp so that said ramp is adapted to be disposed at a location flush with and immediately adjacent to one end of the sill assembly; and said front wall having an opening formed therein, whereby said ramp directs water received thereon into said chamber and to drain through the opening in said front wall.

7. The end plug of claim 6 further including a guide member extending laterally from said support wall for properly positioning said end plug in the one end of the sill assembly.

8. The end plug of claim 7 wherein said guide member comprises a flange.

9. The end plug of claim 6 further including a hinged weep door positioned to close said opening in said front wall.

10. The end plug of claim 6 further including a mounting plate extending laterally from said support wall for mounting an upstanding jamb thereto.

11. The end plug of claim 10 wherein said mounting plate extends longitudinally between said rear and front walls of said body.

* * * * *